US006466169B1

(12) United States Patent
Harrell et al.

(10) Patent No.: US 6,466,169 B1
(45) Date of Patent: Oct. 15, 2002

(54) PLANAR SERPENTINE SLOT ANTENNA

(76) Inventors: Daniel W. Harrell, 2 Sudden Valley Dr., SE. #15, Bellingham, WA (US) 98225; Pamela R. Wallace, Rte. 1 Box 217 A, Lost Creek, WV (US) 26385; Denzil J. Parsons, 207 Joy La., Bridgeport, WV (US) 26330

( * ) Notice: Subject to any disclaimer, the term of this patent is extended or adjusted under 35 U.S.C. 154(b) by 0 days.

(21) Appl. No.: 09/730,712

(22) Filed: Dec. 6, 2000

Related U.S. Application Data

(60) Provisional application No. 60/168,775, filed on Dec. 6, 1999.

(51) Int. Cl.[7] ..... H01Q 1/38; H01Q 1/36

(52) U.S. Cl. ..... 343/700 MS; 343/895; 343/767

(58) Field of Search ..... 343/700 MS, 725, 343/767, 793, 795, 895, 850

(56) References Cited

U.S. PATENT DOCUMENTS

| | | | | |
|---|---|---|---|---|
| 4,038,662 A | | 7/1977 | Turner | 343/752 |
| 4,410,891 A | | 10/1983 | Schaubert et al. | 343/700 MS |
| 4,509,209 A | | 4/1985 | Itoh et al. | 455/327 |
| 4,559,539 A | | 12/1985 | Markowitz et al. | 343/725 |
| 4,987,421 A | | 1/1991 | Sunahara et al. | 343/700 MS |
| 4,987,424 A | | 1/1991 | Tamura et al. | 343/795 |
| 5,124,714 A | | 6/1992 | Harada | 343/713 |
| 5,333,002 A | * | 7/1994 | Gans et al. | 343/700 MS |
| 5,363,114 A | | 11/1994 | Shoemaker | 343/828 |
| 5,371,507 A | | 12/1994 | Kuroda et al. | 343/700 MS |
| 5,649,350 A | | 7/1997 | Lampe et al. | 29/600 |
| 5,714,961 A | | 2/1998 | Kot et al. | 343/769 |
| 5,754,143 A | * | 5/1998 | Warnagiris et al. | 343/767 |
| 6,292,154 B1 | * | 9/2001 | Deguchi et al. | 343/806 |

* cited by examiner

*Primary Examiner*—Don Wong
*Assistant Examiner*—Hoang Nguyen

(57) ABSTRACT

A planar surface antenna comprising two conducting etched patterns on an insulating substrate where the first conductor has a planar serpentine shape defining a plurality of parallel, spaced apart radiator elements. A second etched conductor pattern has comb-like portions interleaved within the radiator elements of the first conductor. A coaxial conductor provides the feed signal to the second conductor with its ground connection to the first conductor. The resonant frequency, impedance, and bandwidth of the antenna are controlled by total length of serpentine radiator element widths and lengths. The antenna forms a non directional radiating antenna. Two of these serpentine antennas can be combined into one antenna to form a directional radiating antenna. The feed signal is connected to the second conductor of a first antenna and the first conductor of a second antenna. The ground wire is connected to the first conductor of the first antenna and the second conductor of the second antenna, realizing a small directional antenna.

18 Claims, 3 Drawing Sheets

PLANAR SERPENTINE SLOT ANTENNA

This Patent Application is based on a Provisional Patent Application, filed Dec. 6, 1999, Serial No. 60/168,775, entitled "PLANAR SERPENTINE SLOT ANTENNA", by the same Inventors.

BACKGROUND OF THE INVENTION (1) Field of the Invention

This invention relates to planar surface antennas having two segments, each comprising two conducting etched patterns on respective insulating substrates. A single antenna is used to form an omni-directional antenna and two interconnected antenna elements are used to form a directional antenna.

(2) Description of the Related Art

U.S. Pat. No. 5,714,961 to Kot et al. describes a directional planar antenna having a number of coaxial ring-slot radiating elements.

U.S. Pat. No. 4,559,539 to Markowitz et al. describes a spiral antenna deformed to receive another antenna.

U.S. Pat. No. 5,363,114 to Shoemaker describes planar serpentine antennas.

U.S. Pat. No. 4,509,209 to Itoh et al. describes an integrated planar antenna-mixer device for microwave reception. A diode quad is connected to the antenna.

U.S. Pat. No. 5,124,714 to Harada describes a planar antenna for automobiles.

U.S. Pat. No. 4,410,891 to Schaubert et al. describes a polarized micro-strip antenna. The polarization can be changed from vertical linear to horizontal linear, left circular, right circular or and desired elliptical sense.

U.S. Pat. No. 5,371,507 to Kuroda et al. describes a planar antenna comprising a ground conductor, a dielectric layer laminated on the ground conductor, and a radiation element laminated on the dielectric layer.

U.S. Pat. No. 4,987,421 to Sunahara et al. describes a micro-strip antenna having an annular radiation conductor with a central opening.

U.S. Pat. No. 4,038,662 to Turner describes a broadband antenna in the form of a multiple element interlaced dipole array mounted on a thin elongated strip of dielectric material.

U.S. Pat. No. 5,649,350 to Lampe et al. describes a method of mass producing printed circuit antennas.

U.S. Pat. No. 4,987,424 to Tamura et al. describes an antenna apparatus having flexible antennas made of conductive material on a flexible insulating sheet.

SUMMARY OF THE INVENTION

Antennas, including directional and omni-directional planar antennas, are useful in any number of applications including communications and navigation. This invention describes planar, broadband antennas which are relatively easy and inexpensive to fabricate and which can be either directional or non directional.

It is a principle objective of this invention to provide a planar, inexpensive radiating antenna wherein the radiation from the antenna produces an omni-directional radiation pattern.

It is another principle objective of this invention to provide a planar, inexpensive radiating antenna wherein the radiation from the antenna is dependent on the direction from the antenna.

These objectives are achieved by forming two conducting etched patterns on planar substrates of dielectric material. The two conducting patterns are etched in a layer of conducting material formed on the substrates. The first conductor has a planar serpentine shape defining a plurality of parallel, spaced apart radiator elements. The second conductor has comb-like portions interleaved within the radiator elements of the first conductor.

In one embodiment the antenna is formed by using a pair of substrates with etched patterns as described above. The pair of substrates is disposed in the same plane with the second conductor of each half connected to the two electrical terminals of a coaxial cable. The first conductor of each antenna in the pair remains electrically floating and not connected to any conductor. The first conductor is used to provide fine tuning capability to the antenna. The spacing between the two conductors may be adjusted to change both the capacitive and inductive relationship of the two. Additionally, the antenna may be tuned by placing a shunt element between the first and second conductors. This shunt may be moved in order to fine tune the antenna.

In a second embodiment, there will be several pairs of the above described antenna, each placed in another plane, providing an antenna having directional radiation patterns.

DESCRIPTION OF THE PREFERRED EMBODIMENTS

Figure 1:
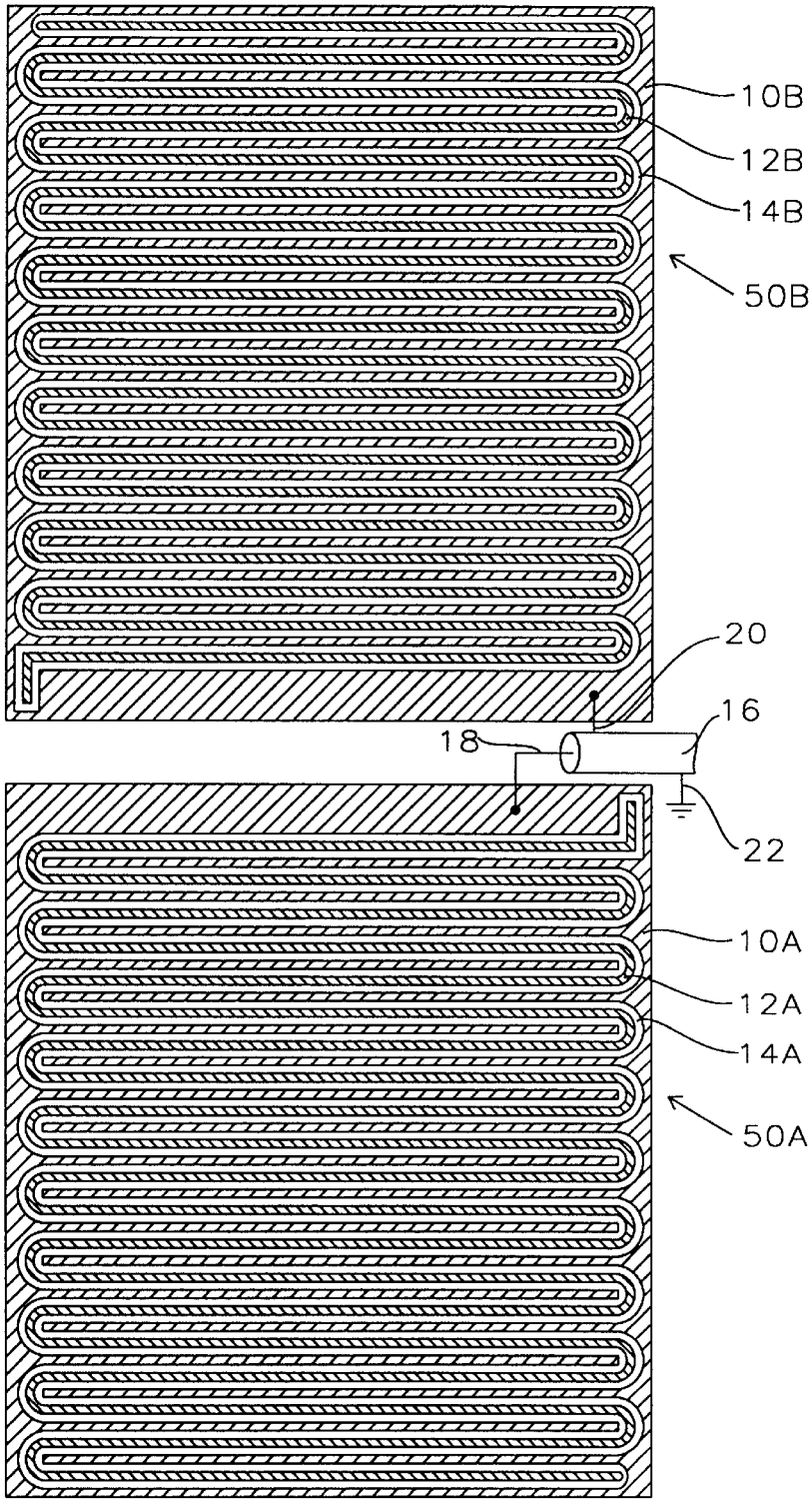
FIG. 1 shows a top view of the basic antenna of this invention showing the coaxial cable providing an electrical feed signal to the second conductor of one antenna segment and electrical ground connection to the second conductor of the other antenna segment. The serpentine first conductors of each antenna segment are electrically isolated and used as a tuning mechanism to tune the antenna to 50 ohms by altering the spacing and placing shunts between the elements.
Figure 2:
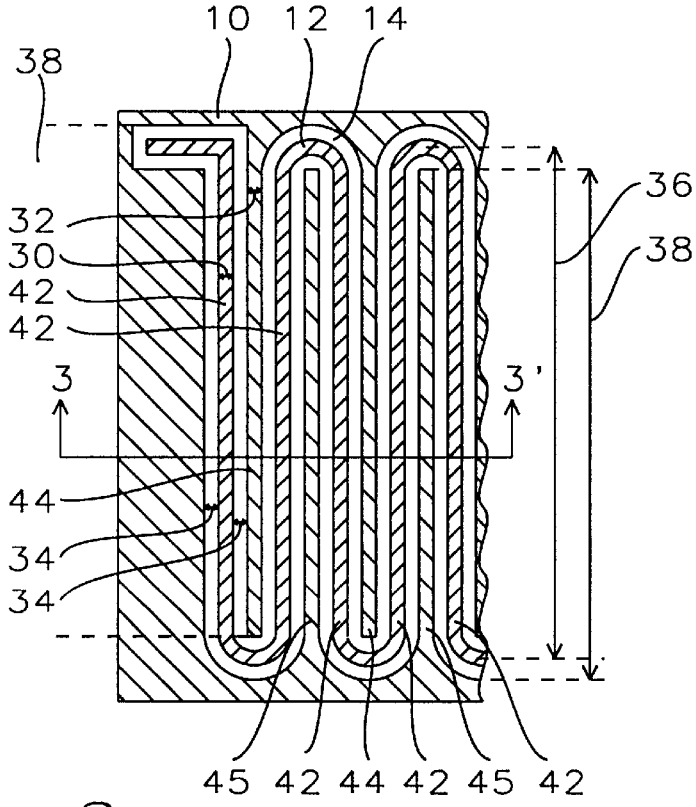
FIG. 2 shows a more detailed view of a part of one of the antenna segments of FIG. 1.
Figure 3:
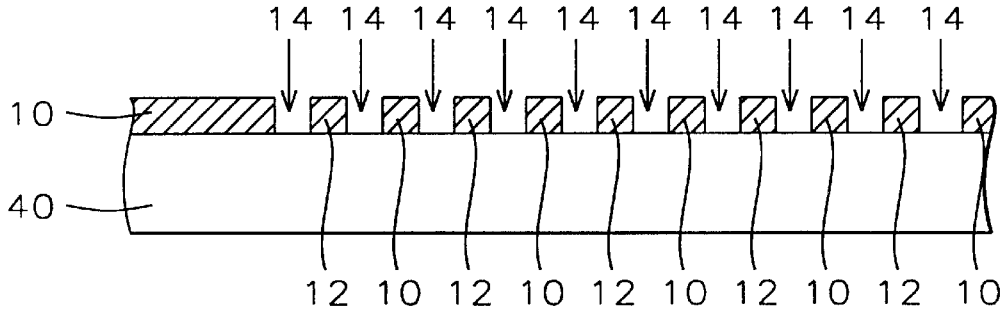
FIG. 3 shows a cross section view of the part of the antenna shown in FIG. 2 taken along line 3—3' of FIG. 2.
Figure 4:
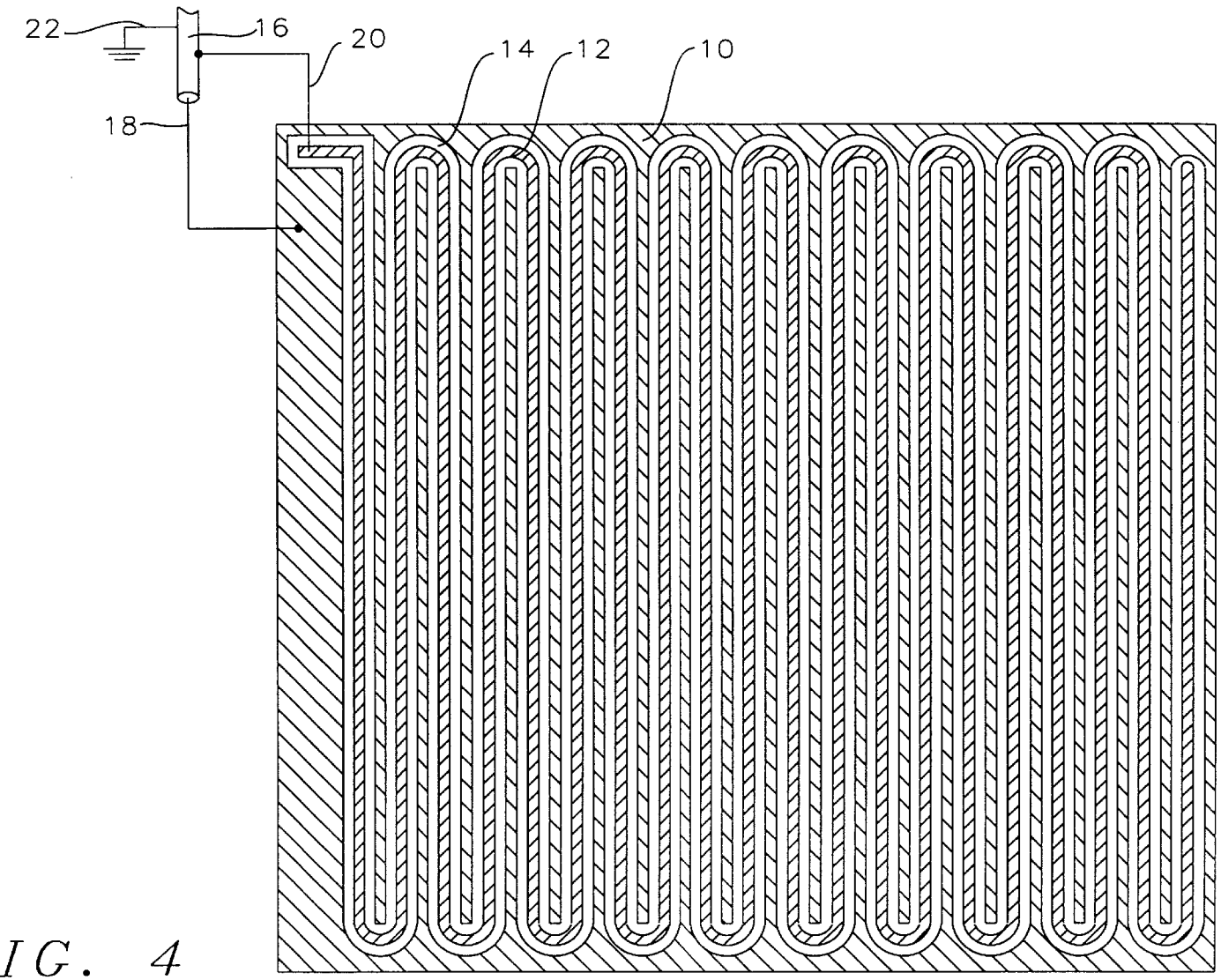
FIG. 4 shows a more detailed top view of one of the identical antenna segments.

Refer now to FIGS. 1—3 for a description of the preferred embodiment of a non-directional antenna of this invention. FIG. 1 shows a top view of the antenna of this invention comprising two identical antenna segments, a first antenna segment 50A and a second antenna segment 50B, which are connected to a coaxial cable. Each segment, 50A and 50B, of the antenna is a planar structure made from a dielectric material, such as standard printed circuit material or any other dielectric material that is coated with a conductive material. The conductive material in each antenna segment has an etched pattern creating serpentine first conductors, 12A in the first antenna segment and 12B in the second antenna segment, and second conductors, 10A in the first antenna segment and 10B in the second antenna segment, having comb-like elements interleaved within the radiator elements of the first conductors, 12A and 12B. Each antenna segment has an insulating gap, 14A in the first antenna segment and 14B in the second antenna segment, between the first conductor, 12A and 12B, and the second conductor 10A and 10B. In order to aid in visualizing each of the identical antenna elements, refer to FIG. 4. In FIG. 4 the first conductor 12 is shaded and the second conductor 10 is cross hatched. A gap 14 insulates the first conductor 12 from the second conductor 10.

FIG. 2 shows a more detailed view of a part of the antenna segment shown in FIG. 4. In FIG. 2 both the first conductor 12 and second conductor 10 are cross hatched to increase the visualization of the antenna. As shown in FIG. 2, the first conductor 12 is formed on a dielectric substrate. The first conductor 12 has a plurality of parallel and equally spaced first elements 42. Each of the first elements 42 has a length 36 and a width 30 and the first elements are electrically connected together in series forming a planar serpentine shape. The second conductor 10 has second elements 44 and third elements 45 formed on the substrate. Each of the second elements 44 and third elements 45 has a length 38 and a width 32. The second elements 44 and the third elements 45 are each disposed between adjacent first elements 42 so that there is an insulating gap 14, with a gap width 34, between each of the second elements 44 and the adjacent first elements 42 and between each of the third elements 45 and the adjacent first elements 42. The second elements 44 and the third elements 45 are electrically connected to each other and electrically insulated from the first elements 42.

FIG. 3 shows a cross section of the part of the antenna shown in FIG. 2 taken along line 3–3' of FIG. 2. As shown in FIG. 3, the first conductor 12 and the second conductor 10 are formed on a dielectric substrate 40. The dielectric substrate can be formed from standard printed circuit material or any other dielectric material having a suitable dielectric constant. A layer of conductor material, typically a metal such as copper or aluminum, is formed on the substrate 40 and etched to form the first conductor 12 and second conductor 10.

Referring again to FIG. 1, a coaxial cable 16 is used to supply an electrical feed signal to the second conductor 10A of the first antenna segment 50A and electrical ground to the first conductor 10B of the second antenna segment 50B. FIG. 1 shows the center conductor 18 of the coaxial cable 16 connected to the second conductor 10A of the first antenna segment 50A, a conductor 20 connecting the outer conductor of the coaxial cable 16 to the second conductor lOB of the second antenna segment, and a conductor 22 connecting the outer conductor of the coaxial cable to electrical ground.

The antenna has resonant frequencies comprising a fundamental frequency and integral multiples of the fundamental frequency. The resonant frequency is determined by the geometries of each conductor in the identical first antenna segment 50A and second antenna segment 50B. Referring to FIG. 2, the resonant frequencies are further defined by the width 30 and length 36 of each of the first elements, the width 32 and length 38 of each of the second elements 44 and third elements 45, and the length of the serpentine first conductor 12. The length of the serpentine first conductor 12 can be determined from the length 36 of the first elements 42 and the total number of first elements 42, see FIG. 2. The resonant frequencies of the antenna can be adjusted by adjusting the length of one or more of the second elements 44 or third elements 45, such as by trimming.

The antenna has an impedance which is determined by the width 30 of the first elements 42, the width 32 of the second elements 44 and third elements 45, and the width 34 of the insulating gap 14 between the first elements 42 and the adjacent second elements 44 and third elements 45, see FIG. 2.

The antenna shown in FIGS. 1–3 is an omni-directional antenna. The radiation from the antenna is independent of direction from the antenna.

A single antenna segment, as shown in FIG. 4, can be used as an omni-directional antenna with somewhat poorer gain than the dual-segment antenna shown in FIG. 1–3. The advantage of the single element antenna shown in FIG. 4 is its very small physical size. On this case the center conductor 18 of the coaxial cable 16 is connected to the second conductor 10. The outer conductor of the coaxial cable 16 is connected to the first conductor 12 of the antenna by a conductor 20 and to ground by another connector 22 so that the first conductor 12 of the antenna is connected to ground.

The antennas described above are passive antennas. An amplifier can be added between the center conductor of the coaxial cable in order to amplify the antenna signal. Using low-loss switches the amplifier can be by passed if the signal needs no amplification. With low level signals, it is often very desirable to amplify the signal before transmitting the signal through the coaxial cable. Such an amplifier could be fabricated in an integrated circuit chip and mounted on the dielectric material of the antenna on the opposite side from the antenna first 12 and second 10 conductors. Internal ground planes could be used to isolate the amplifier from the antenna.

These antenna segments could also be fabricated on one of the metal layers of an integrated circuit. Due to smaller dimensions such an antenna would be resonant at higher frequencies than the antenna described above. Metal layers may also be used to shield such an antenna from the remainder of the integrated circuit.

The antennas of this invention are planar antennas which can fabricated by etching conductor patterns in a layer of conducting material formed on a dielectric substrate. These antennas are easily fabricated at low cost. A number of the planar antennas shown in FIG. 1 can also be used in an array to increase gain and directivity.

While the invention has been particularly shown and described with reference to the preferred embodiments thereof, it will be understood by those skilled in the art that various changes in form and details may be made without departing from the spirit and scope of the invention.

What is claimed is:

1. An antenna, comprising:

a substrate, wherein said substrate is a planar substrate formed of a dielectric material;

a first conductor formed on said substrate, wherein said first conductor has a plurality of parallel spaced apart first elements, each of said first elements has a length and a width, said first elements are electrically connected together in series, and said series connected first elements form a planar serpentine shape;

a second conductor having second elements and third elements formed on said substrate, wherein each of said second elements has a length and a width, each of said third elements has a length and a width, said second elements are electrically connected together forming a planar comb-like shape, said third elements are electrically connected together forming a comb-like shape, said second elements are disposed between adjacent said first elements so that there are insulating gaps between each of said second elements and adjacent said first elements, said third elements are disposed between adjacent said first elements so that there are insulating gaps between each of said third elements and adjacent said first elements, said second elements and said third elements are all electrically connected together, and said second elements and said third elements are all electrically insulated from said first elements; and means to supply an electrical feed signal to said second conductor and electrical ground to said first conductor.

2. The antenna of claim 1 wherein said antenna has resonant frequencies comprising a fundamental frequency and integral multiples of said fundamental frequency.

3. The antenna of claim 1 wherein said antenna has resonant frequencies and said resonant frequencies are determined by said width of each of said first elements, said length of each of said first elements, the total number of said first elements, said width of each of said second elements, said length of each of said second elements, said width of each of said third elements, and said length of each of said third elements.

4. The antenna of claim 1 wherein said antenna has resonant frequencies and said resonant frequencies can be adjusted by adjusting said length of one or more of said second elements or said length of one or more of said third elements.

5. The antenna of claim 1 wherein said antenna has an impedance and said impedance is determined by said widths and said lengths of each of said first, second, and third elements, said insulating gaps between said second elements and adjacent said first elements, and said insulating gaps between said third elements and adjacent said first elements.

6. The antenna of claim 1 wherein said means to supply an electrical feed signal to said second conductor and electrical ground to said first conductor comprises a coaxial cable having a center conductor and an outer conductor wherein said center conductor of said coaxial cable is electrically connected to said second conductor and said outer conductor of said coaxial cable is electrically connected to said first conductor.

7. The antenna of claim 1 wherein the radiation from said antenna is substantially independent of the direction from said antenna.

8. The antenna of claim 1 wherein said first conductor and said second conductor are formed by etching a layer of conducting material formed on said substrate.

9. An antenna, comprising:

a first substrate, wherein said first substrate is a planar substrate formed of a dielectric material;

a second substrate, wherein said second substrate is a planar substrate formed of said dielectric material and disposed in the same plane as said first substrate;

a first conductor formed on said first substrate, wherein said first conductor has a plurality of parallel spaced apart first elements, each of said first elements has a length and a width, said first elements are electrically connected together in series, and said series connected first elements form a planar serpentine shape;

a second conductor having second elements and third elements formed on said first substrate, wherein each of said second elements has a length and a width, each of said third elements has a length and a width, said second elements are electrically connected together forming a planar comb-like shape, said third elements are electrically connected together forming a comb-like shape, said second elements are disposed between adjacent said first elements so that there are insulating gaps between each of said second elements and adjacent said first elements, said third elements are disposed between adjacent said first elements so that there are insulating gaps between each of said third elements and adjacent said first elements, said second elements and said third elements are all electrically connected together, and said second elements and said third elements are all electrically insulated from said first elements;

a third conductor formed on said second substrate, wherein said third conductor has a plurality of parallel spaced apart fourth elements, each of said fourth elements has a length and a width, said fourth elements are electrically connected together in series, and said series connected fourth elements form a planar serpentine shape;

a fourth conductor having fifth elements and sixth elements formed on said second substrate, wherein each of said fifth elements has a length and a width, each of said sixth elements has a length and a width, said fifth elements are electrically connected together forming a planar comb-like shape, said sixth elements are electrically connected together forming a comb-like shape, said fifth elements are disposed between adjacent said fourth elements so that there are insulating gaps between each of said fifth elements and adjacent said fourth elements, said sixth elements are disposed between adjacent said fourth elements so that there are insulating gaps between each of said sixth elements and adjacent said fourth elements, said fifth elements and said sixth elements are all electrically connected together, and said fifth elements and said sixth elements are all electrically insulated from said first elements; and means to supply an electrical feed signal to said second conductor and electrical ground to said fourth conductor leaving said first and third conductors electrically isolated.

10. The antenna of claim 9 wherein said first dielectric material and said second dielectric material are the same dielectric material.

11. The antenna of claim 9 wherein said antenna has resonant frequencies comprising a fundamental frequency and integral multiples of said fundamental frequency.

12. The antenna of claim 9 wherein said antenna has resonant frequencies and said resonant frequencies are determined by said width of each of said first elements, said length of each of said first elements, the total number of said first elements, said width of each of said second elements, said length of each of said second elements, said width of each of said third elements, said length of each of said third elements, said length of each of said fourth elements, the total number of said fourth elements, said width of each of said fifth elements, said length of each of said fifth elements, said width of each of said sixth elements, and said length of each of said sixth elements.

13. The antenna of claim 9 wherein said antenna has resonant frequencies and said resonant frequencies can be adjusted by adjusting said length of one or more of said second elements, said length of one or more of said third elements, said length of one or more of said fifth elements, or said length of one or more of said sixth elements.

14. The antenna of claim 9 wherein said antenna has an impedance and said impedance is determined by said widths and said lengths of each of said first, second, third, fourth, fifth, and sixth elements, said insulating gaps between said second elements and adjacent said first elements, said insulating gaps between said third elements and adjacent said first elements, said insulating gaps between said fifth elements and adjacent said fourth elements, and said insulating gaps between said sixth elements and adjacent said fourth elements.

15. The antenna of claim 9 wherein said means to supply an electrical feed signal said second conductor and said third conductor and electrical ground to said first conductor and said fourth conductor comprises a coaxial cable having a center conductor and an outer conductor wherein said center conductor of said coaxial cable is electrically connected to said second conductor and said third conductor, and said outer conductor of said coaxial cable is electrically connected to said first conductor and said fourth conductor.

16. The antenna of claim 9 wherein the radiation from said antenna is independent of the direction from said antenna.

17. The antenna of claim 9 wherein said first conductor and said second conductor are formed by etching a layer of conducting material formed on said first substrate, and said third conductor and said fourth conductor are formed by etching a layer of said conducting material formed on said second substrate.

18. The antenna of claim 9 further comprising means to amplify said electrical feed signal supplied to said second conductor.

* * * * *